US009930979B2

(12) United States Patent
Miller et al.

(10) Patent No.: US 9,930,979 B2
(45) Date of Patent: Apr. 3, 2018

(54) CYLINDRICAL CONTAINER AND SERVING BOWL

(71) Applicant: Sonoco Development, Inc., Hartsville, SC (US)

(72) Inventors: Paul Edward Miller, Cheraw, SC (US); Jamie Lynn Ackerman, Hartsville, SC (US); Lawrence Robert Carpenter, Darlington, SC (US); Steven Kubilius, Florence, SC (US)

(73) Assignee: Sonoco Development, Inc., Hartsville, SC (US)

( * ) Notice: Subject to any disclaimer, the term of this patent is extended or adjusted under 35 U.S.C. 154(b) by 115 days.

(21) Appl. No.: 15/007,833

(22) Filed: Jan. 27, 2016

(65) Prior Publication Data

US 2017/0112303 A1 Apr. 27, 2017

Related U.S. Application Data

(60) Provisional application No. 62/244,453, filed on Oct. 21, 2015.

(51) Int. Cl.

| | |
|---|---|
| ***A47G 19/02*** | (2006.01) |
| ***B65D 81/36*** | (2006.01) |
| ***B65D 65/06*** | (2006.01) |
| ***B65D 71/06*** | (2006.01) |
| ***B65D 5/30*** | (2006.01) |

(Continued)

(52) U.S. Cl.

CPC ..... *A47G 19/02* (2013.01); *A47G 19/03* (2013.01); *A47G 21/001* (2013.01); *B65D 3/06* (2013.01); *B65D 3/28* (2013.01); *B65D 5/0005* (2013.01); *B65D 5/06* (2013.01); *B65D 5/308* (2013.01); *B65D 5/56* (2013.01); *B65D 21/08* (2013.01); *B65D 25/14* (2013.01); *B65D 25/205* (2013.01); *B65D 31/10* (2013.01); *B65D 31/18* (2013.01); *B65D 43/02* (2013.01); *B65D 65/02* (2013.01);

(Continued)

(58) Field of Classification Search

CPC ..... B65D 5/30–5/308; B65D 3/06; B65D 81/36–81/368; B65D 65/06; B65D 71/066; B65D 5/0281; B65D 5/24–5/248; B65D 5/324; A47G 21/001; A47G 19/03

USPC ..... 229/103, 103.2, 4.5; 426/115; 220/23.86, 23.88; 141/331, 337

See application file for complete search history.

(56) References Cited

U.S. PATENT DOCUMENTS

| | | | |
|---|---|---|---|
| 3,498,798 | A | 3/1970 | Baur et al. |
| 6,359,272 | B1 | 3/2002 | Sadek et al. |

(Continued)

FOREIGN PATENT DOCUMENTS

| | | |
|---|---|---|
| KR | 2020130000820 | 1/2013 |

OTHER PUBLICATIONS

Alex Plunkett; "http://www.alexplunkett.de/"; short article and pictures taken from website; discovered May 18, 2016.

*Primary Examiner* — Anthony Stashick
*Assistant Examiner* — Mollie Impink
(74) *Attorney, Agent, or Firm* — Miller, Matthias & Hull LLP

(57) ABSTRACT

A cylindrical container having a plastic overcap and flexible panels that can be assembled into a serving bowl are provided. The cylindrical container may hold snack foods or other items. The flexible bowl panels lock together and may mate with the overcap to form the serving bowl. The flexible (Continued)

bowl panels may be packaged outside one or more cylindrical containers or may fit inside a container.

8 Claims, 8 Drawing Sheets

(51) Int. Cl.

| | |
|---|---|
| ***A47G 21/00*** | (2006.01) |
| ***A47G 19/03*** | (2006.01) |
| ***B65D 5/06*** | (2006.01) |
| ***B65D 21/08*** | (2006.01) |
| ***B65D 25/14*** | (2006.01) |
| ***B65D 25/20*** | (2006.01) |
| ***B65D 30/20*** | (2006.01) |
| ***B65D 43/02*** | (2006.01) |
| ***B65D 65/02*** | (2006.01) |
| ***B65D 71/40*** | (2006.01) |
| ***B65D 30/28*** | (2006.01) |
| ***B65D 3/06*** | (2006.01) |
| ***B65D 3/28*** | (2006.01) |
| ***B65D 5/355*** | (2006.01) |
| ***B65D 5/56*** | (2006.01) |

(52) U.S. Cl.
CPC ..... *B65D 65/06* (2013.01); *B65D 71/066* (2013.01); *B65D 71/40* (2013.01); *B65D 81/36* (2013.01)

(56) References Cited

U.S. PATENT DOCUMENTS

2007/0241172 A1* 10/2007 Miller ..... B65D 5/0005 229/101
2016/0096648 A1 4/2016 Pnkstone et al.

* cited by examiner

CYLINDRICAL CONTAINER AND SERVING BOWL

BACKGROUND OF THE INVENTION

Field of the Invention

This disclosure relates to a container for holding snack foods and other items. More particularly, this disclosure relates to a cylindrical container for holding snack foods and other items that can be transformed into a bowl-like serving container, or a container system comprising a cylindrical container and flexible interlocking panels that can be stored either inside or outside the cylindrical container and assembled into a serving bowl.

Description of the Related Art

Composite containers are commonly used to hold snack foods, drink mixes and other consumable foods. A typical composite container has a cylindrical body or sidewall, a plastic or metal bottom and a plastic overcap. The container body may be comprised of a polyfoil inner liner, a paperboard structural layer and a paper outer label. The polyfoil inner layer has a moisture-proof thermoplastic layer that may contact the container contents, a metallic foil layer adjacent the thermoplastic layer, and an outer paper layer. A membrane seal may be positioned under the plastic overcap and sealed to the top edge of the container to help maintain the freshness of the contents and extend its shelf life. To access the contents the user lifts off the overcap and peals away the membrane seal.

When used for snack foods, such containers do not readily lend themselves to sharing the contents of the container unless the container is passed around. The present disclosure is designed to address this problem by providing a container that can be transformed into a serving container for easy sharing or a container system comprising a cylindrical container and flexible interlocking panels that can be stored either inside or outside the cylindrical container and assembled into a serving bowl.

BRIEF SUMMARY OF THE INVENTION

The present disclosure relates to a container for holding a product such as snack food.

In a first embodiment a segmented container is transformable into a serving bowl.

In a second embodiment a container system is provided comprising a cylindrical container and flexible panels that can be locked together to form a bowl using an overcap as base.

In a third embodiment a container system is provided comprising a cylindrical container and flexible panels that can be locked together to form a bowl with integral bottom tabs as a base.

In a fourth embodiment a container system is provided comprising a cylindrical container and flexible panels that can be removed from the container and locked together to form a bowl using an overcap as base.

In a fifth embodiment a container system is provided comprising a cylindrical container and flexible panels that can be removed from the container and locked together to form a bowl with integral bottom tabs as a base.

In a sixth embodiment a pleated container is transformable into a serving bowl.

DETAILED DESCRIPTION OF THE INVENTION

Figure 1:
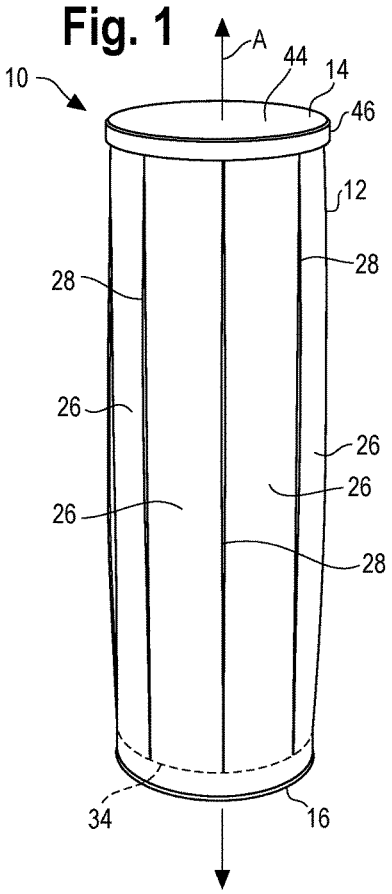
FIG. 1 is a perspective view of a container according to a first embodiment.

While the invention described herein may be embodied in many forms, there is shown in the drawings and will herein be described in detail one or more embodiments with the understanding that this disclosure is to be considered an exemplification of the principles of the invention and is not intended to limit the disclosure to the illustrated embodiments.

First Embodiment—Container Transforms into a Bowl

Turning to the drawings, there is shown in FIG. 1-5 one embodiment of the disclosure, a container 10 for holding a product 48 such as snack food or other items, the container 10 being transformable into a serving bowl.

FIG. 1 is a perspective view of the container 10. The container 10 comprises a sidewall 12, an overcap 14, a bottom or end cap 16, an inner sleeve 18 and an optional seal membrane 20. The plastic overcap 14 is removably secured to the top rim 22. The plastic overcap 14 may have a covering portion 44 and a sidewall 46 extending orthogonally from the periphery of the covering portion 44 and may form a snap fit with the beaded top rim 22. The end cap 16 may be permanently secured to the bottom rim 24. The end cap 16 may be made from plastic, metal or any other suitable material and may be glued or otherwise affixed to the bottom rim 24.

Figure 2:
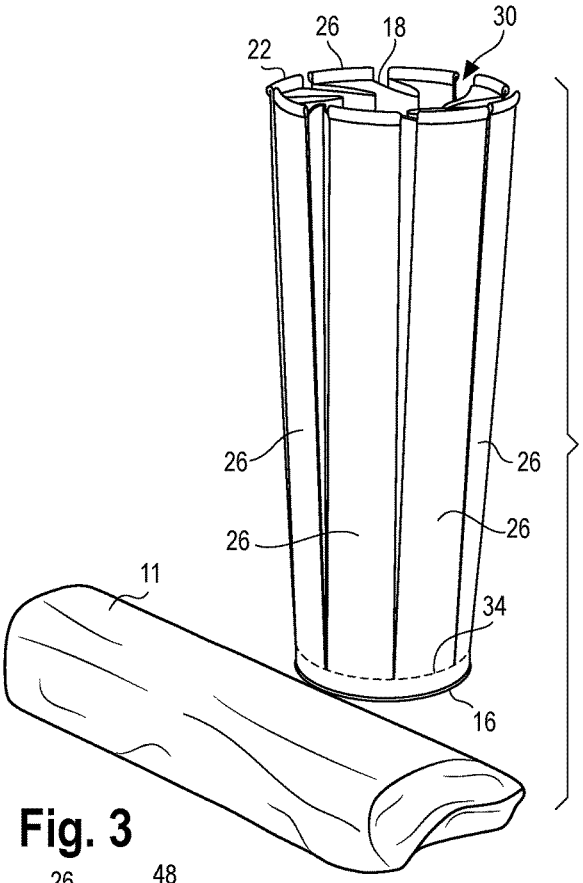
FIG. 2 is perspective view of the container of FIG. 1 with the wrapped contents removed and the container partially transformed into a bowl.
Figure 3:
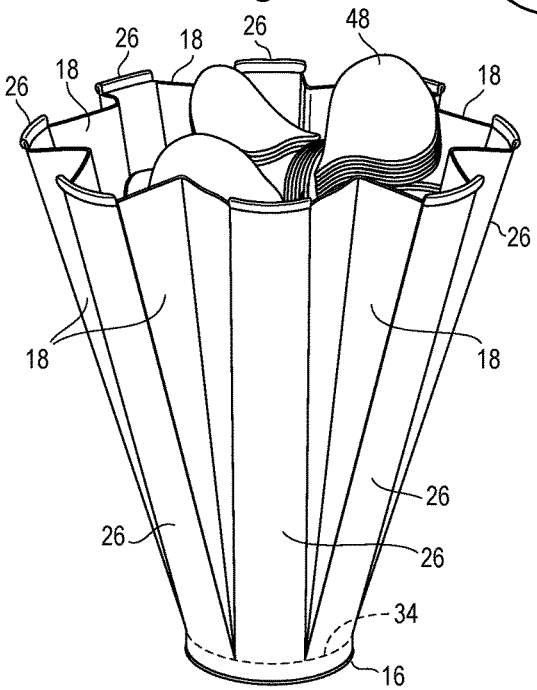
FIG. 3 is perspective view of the container of FIG. 1 shown transformed into a bowl.

FIG. 2 is perspective view of the container 10 with the wrapped product 11 removed and the container 10 partially transformed into a bowl. FIG. 3 is perspective view of the container 10 shown transformed into a bowl and holding the product 48. The product 48 may be snack food or any suitable product.

Figure 4:
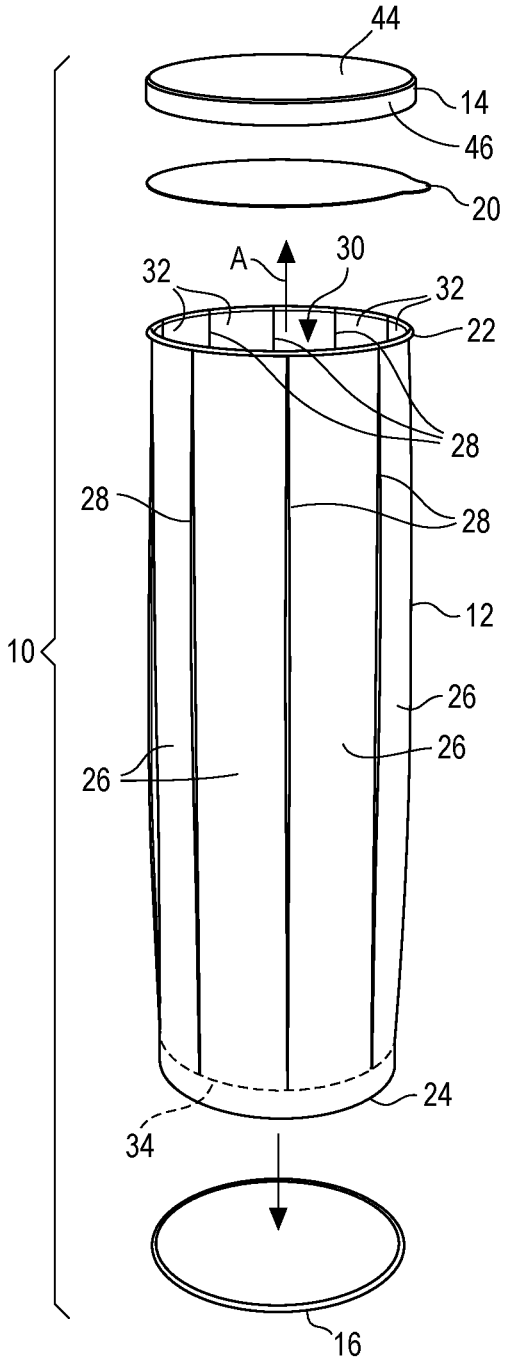
FIG. 4 is an exploded view of the container of FIG. 1 shown without an inner sleeve.

FIG. 4 is an exploded view of the container 10 of FIG. 1 shown without the inner sleeve 18 or wrapped product 11.

The sidewall 12, overcap 14 and end cap 16 define an interior 30 for holding the product 48. The seal membrane 20 may be adhered to the top rim 22 by glue or by any suitable means. The sidewall 12 is cylindrical and has a top rim 22 and a bottom rim 24 and defines a longitudinal central axis (A). Preferably the top rim 22 is beaded and the bottom rim 24 is straight (not beaded).

The sidewall 12 comprises a plurality of longitudinally extending sidewall panels 26. Eight sidewall panels 26 are shown in the figures, although the sidewall 12 may be divided into any suitable number of panels 26. In the unopened container 10 each sidewall panel 26 is connected to adjacent sidewall panels 26 by frangible (breakable) lines 28. The frangible lines 28 may be perforated lines, scored lines, slits or any other suitable frangible lines that allow the sidewall panels 26 to be broken apart by a consumer. Each sidewall panel 26 has an inner facing surface 32 and extends from the top rim 22 down to a circumferential hinge line 34 or to the bottom rim 24. The hinge line 34 may be scored and may be located about ¼ inch above the bottom rim 24. The frangible lines 28 may extend from the top rim 22 down to the circular hinge line 34 or to the bottom rim 24.

The sidewall panels 26 may be somewhat rigid as is characteristic of containers of this kind. The sidewall panels 26 are rotatable about the hinge line 34 between a first position (shown in FIGS. 1 and 4) in which the sidewall panels 26 are vertically upright to form the cylindrical sidewall 12, and a second position (shown in FIG. 3) in which the sidewall panels 26 are splayed outwardly, away from the central axis (A), so that the inner sleeve 18 forms a bowl-like truncated cone shaped structure large enough to hold the product 48 of one or more containers 10.

The sidewall 12 may be any suitable construction. For example, the sidewall 12 may comprise a polyfoil inner liner, a paperboard structural layer and a printed-paper label wrapped around the paperboard structural layer and adhered thereto. The polyfoil inner liner may comprise, from the inside out, a thermoplastic layer (typically polyethylene or polypropylene), a metal foil layer, a second thermoplastic layer and a paper layer, the paper layer adjoining and bonded to the paperboard structural layer of the sidewall 12.

The inner sleeve 18 is disposed in the interior 30 between the product 48 and the sidewall 12. Preferably the inner sleeve 18 is flexible and is adhered to the inner facing surface 32 of each sidewall panel 26. The inner sleeve 18 may be folded over upon itself to form a substantially cylindrical structure in the closed container 10. When the container 10 is transformed into a serving bowl the inner sleeve 18 unfolds to assume a bowl shape.

The inner sleeve 18 may comprise, from the inside out, a thermoplastic layer (typically polyethylene or polypropylene), a metal foil layer, a second thermoplastic layer and a paper layer, the paper layer adjoining and bonded to the sidewall panels 26.

Figure 5:
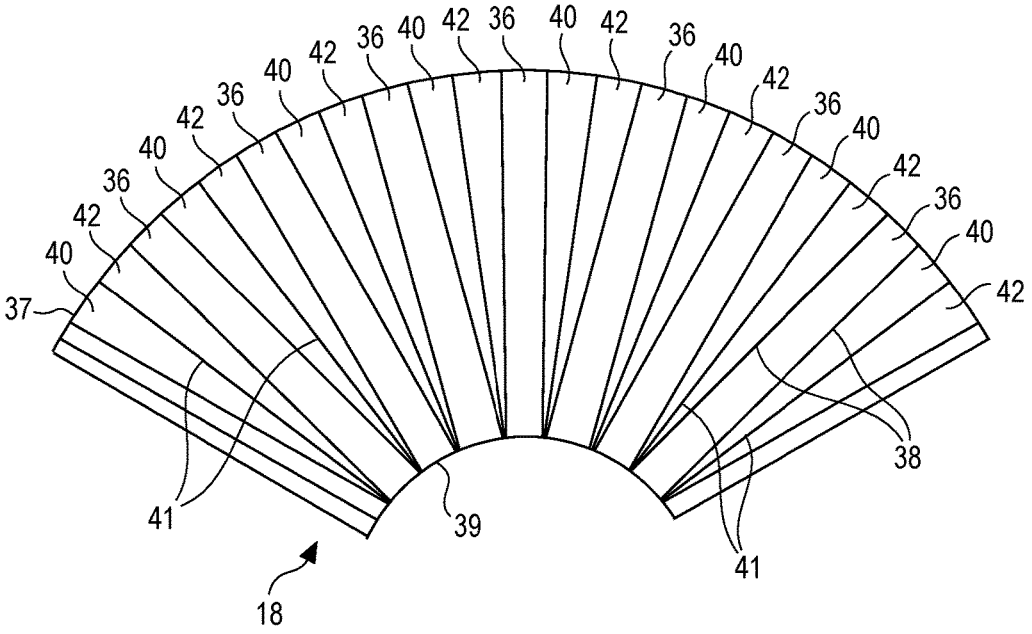
FIG. 5 is a planar view of a sheet of material used to make the inner sleeve of the container of FIG. 1.

FIG. 5 is a planar view of a sheet 19 of material that may be used to make the inner sleeve 18. The sheet 19 has a curved top edge 37 and a curved bottom edge 39 and comprises a plurality of substantially rectangular inner sleeve panels 36. The inner sleeve panels 36 are connected along vertical inner sleeve fold lines 38 on either side to first and second triangular gusset panels 40, 42. The first gusset panels 40 may extend from a point along the sheet bottom edge 39 to the sheet top edge 37. The second gusset panels 42 may extend from the same point along the sheet bottom edge 39 to the sheet top edge 37 and are foldably attached to the first gusset panels 40 along a gusset fold line 41. The sheet 19 may be folded along the fold lines 38 and along the gusset fold lines 41 to form the inner sleeve 18 shown in the figures. The inner sleeve panels 36 may be of similar dimensions to the sidewall panels 26 and are affixed to the inner facing surfaces 32 of the sidewall panels 26 so that the vertical fold lines 38 in the inner sleeve 18 substantially coincide with the frangible lines 28 in the sidewall 12. The gusset panels 40, 42 extend in accordion fashion between the sidewall panels 26.

Method of Manufacture

The container 10 may be made as follows:

1. Wind a web of material into a cylindrical tube.
2. Cut the tube into can bodies.
3. Convey the can bodies to rotary perforation unit.
   a. Load the can bodies onto a mandrel.
   b. Perforate or otherwise weaken the can bodies along a plurality of longitudinally oriented lines to form a sidewall 12 having frangible lines 28.
4. Bead the sidewall top rim 22. Apply an end cap 16.
5. Convey the sidewall 12 to an inner sleeve insertion station.
6. At the inner sleeve insertion station:
   a. Apply hot melt adhesive (web design) in two adhesive locations on each sidewall panel 26 (middle and top).
   b. Insert a pre-folded/pleated inner sleeve 18 and apply pressure from inside the inner sleeve 18 to the adhesive locations.
   c. Discharge the sidewall 12 to a product filling station.
7. Fill with product 48.
8. Apply a seal membrane 20 and an overcap 14.

Second Embodiment—Separate can and Bowl; Overcap Used as Bowl Base

Figure 6:
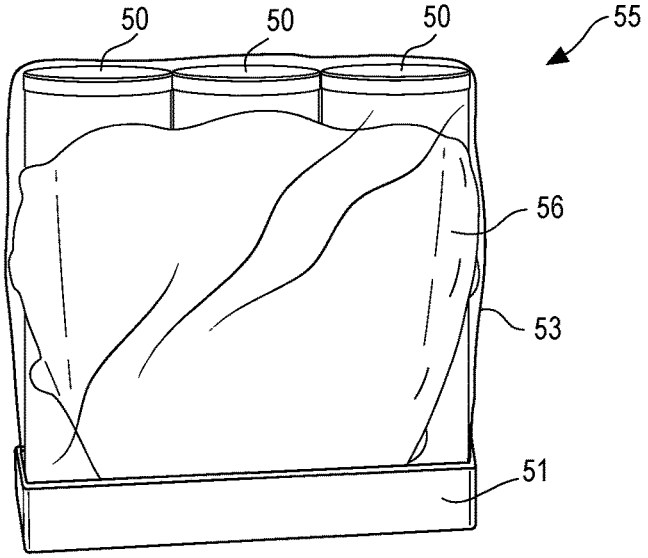
FIG. 6 is a view of a container system according to a second embodiment, including three containers and two bowl panels located outside the containers.

FIG. 6 is a planar view of a retail package 55 according to a second embodiment. The retail package 55 includes three containers 50 and two bowl panels 56. The containers 50 are positioned in a tray 51 and the bowl panels 56 are wedged between the containers 50 and the tray 51 on either side of the containers 50. (One bowl panel 56 in FIG. 6 is obscured by the containers 50.) Transparent flexible wrap 53 may be used to secure and protect the retail package 55. As explained in more detail below, the flexible bowl panels 56 fit together to form a bowl shaped serving container 57. The flexible bowl panels 56 may be packaged with one or more of the containers 50 and may be configured to fit closely with the outside contours of one or more containers 50.

Figure 7:
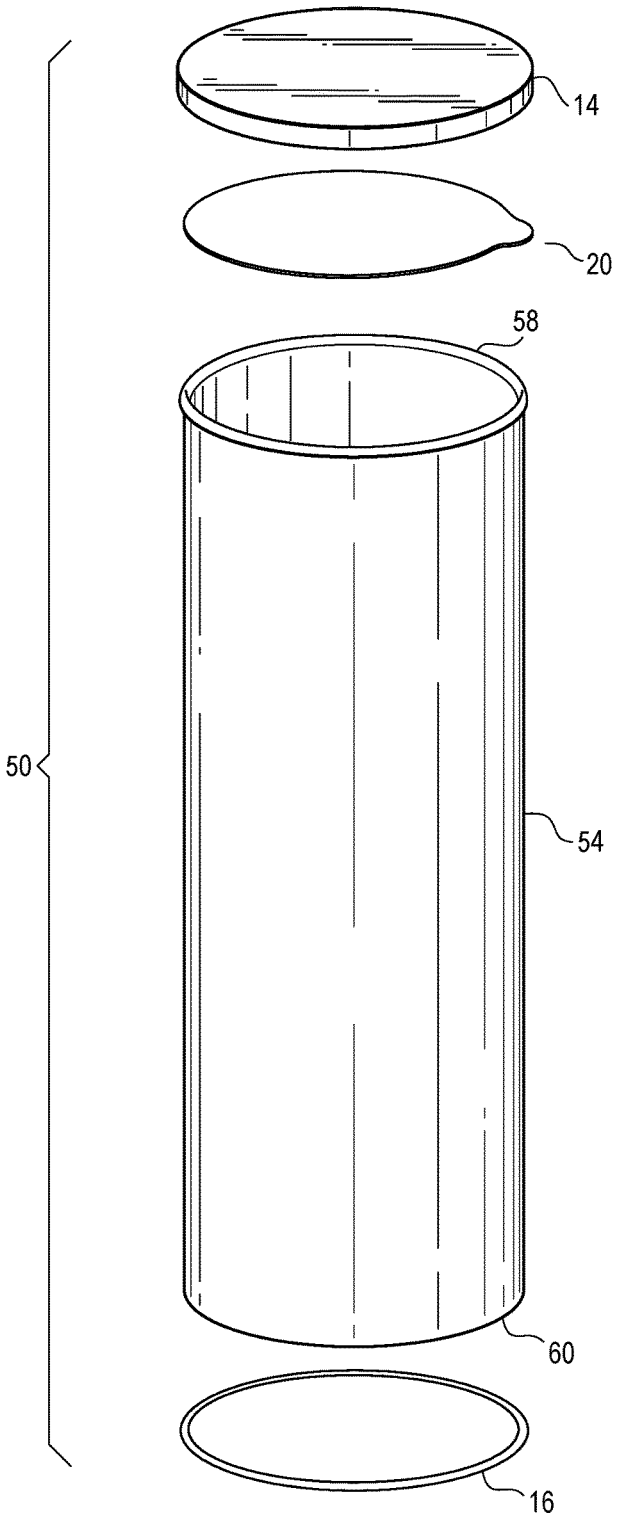
FIG. 7 is an exploded view of one of the containers of FIG. 6.

FIG. 7 is an exploded view of one of the containers 50 of FIG. 6. The container 50 may be conventional in design and may have a cylindrical sidewall 54, an overcap 14, a seal membrane 20 and a bottom or end cap 16. The sidewall 54, overcap 14 and end cap 16 define an interior 30 for holding the product (not shown). The cylindrical sidewall 54 has a beaded top rim 58 and a bottom rim 60. The overcap 14 is removably secured to the top rim 58. The end cap 16 is secured to the bottom rim 60.

Figure 8:
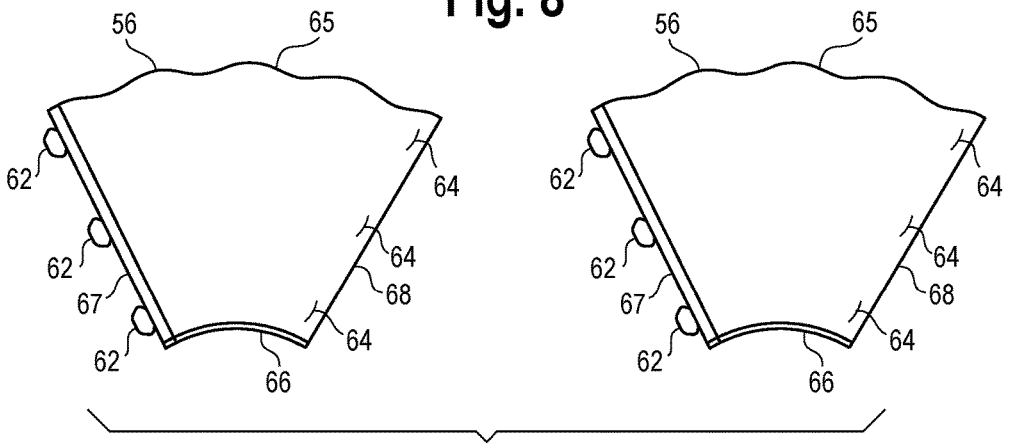
FIG. 8 is a front planar view of the two bowl panels of FIG. 6.

FIG. 8 is a front planar view of the two bowl panels 56 of FIG. 6. Each flexible bowl panel 56 may be formed from a flat blank and have a top edge 65, a bottom edge 66 and side edges 67, 68 extending between the top edge 65 and the bottom edge 66. Locking tabs 62 extend outwardly from one side edge 67. Slots 64 located near the other side edge 68 are configured to receive the locking tabs 62. To construct a two piece "bowl" shaped serving container 57, each bowl panel 56 may be bent so that the top edge 65 and the bottom edge 66 both describe a 180 degree arc.

Figure 9:
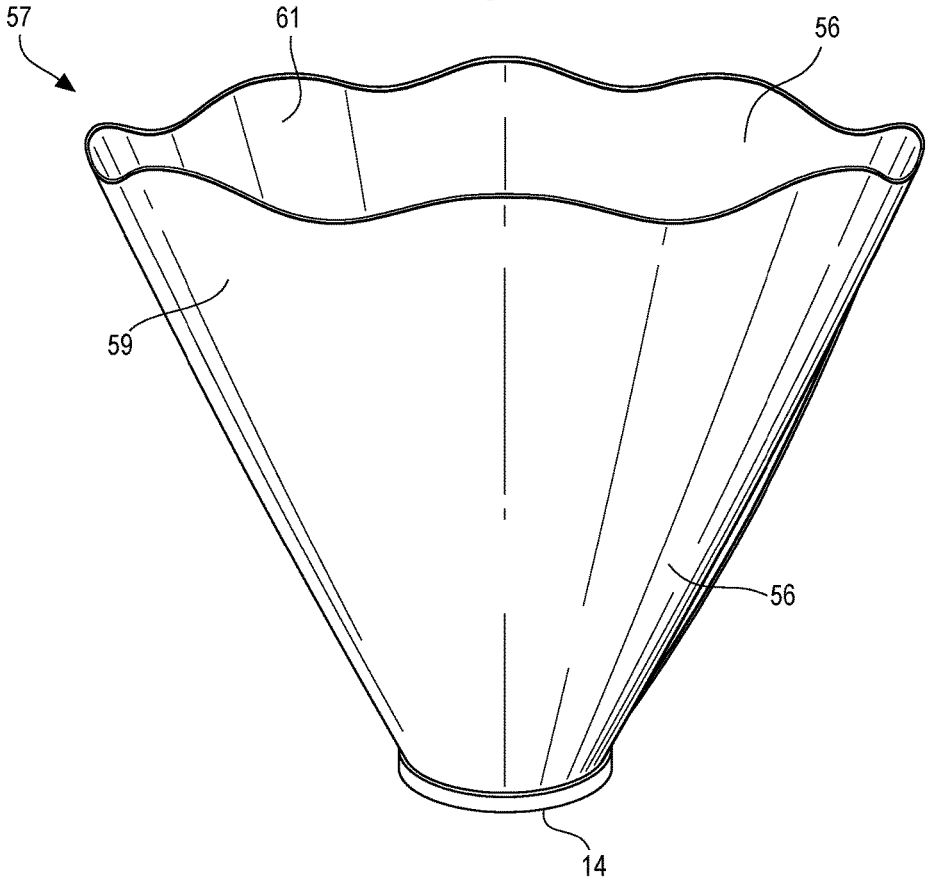
FIG. 9 is a side perspective view of an assembled bowl according to the second embodiment.

FIG. 9 is a side perspective view of an assembled bowl or serving container 57 according to the second embodiment.

The flexible bowl panels 56 are configured to lock together to form a truncated cone, the truncated cone having a circular bottom rim 60 configured to mate with the overcap 14 to form a bowl shaped serving container 57 large enough to hold the product 48 (not shown) of one or more containers 50. The bowl panels 56 may lock together in tab 62 in slot 64 fashion. The outer surface 59 of each bowl panel 56 may carry graphics while the inner surface 61 may be treated to make it suitable for contacting food.

Figure 10:
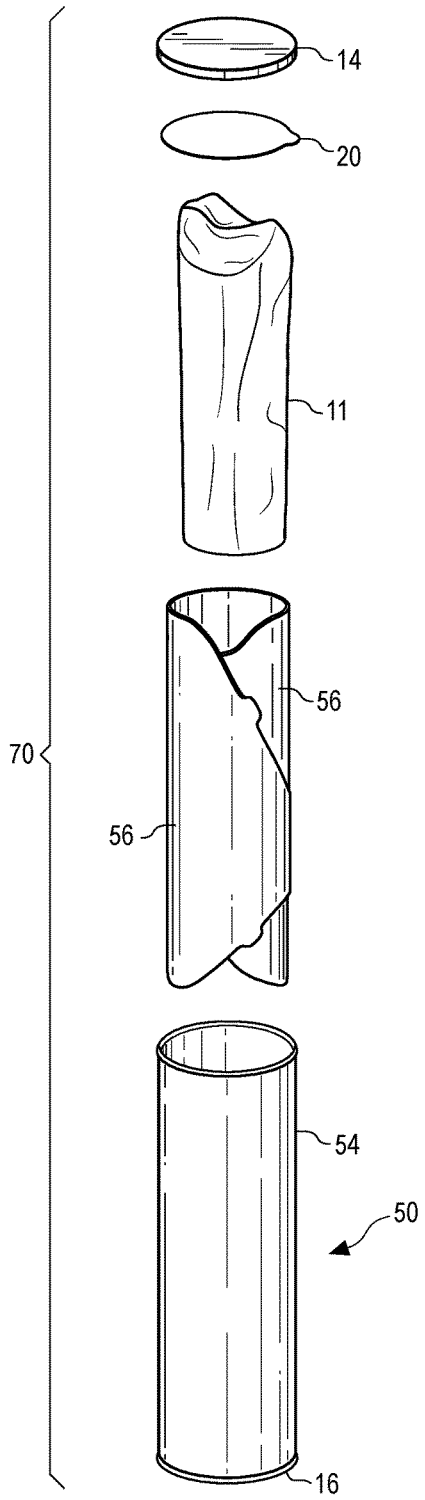
FIG. 10 is an exploded view of a container system according to the second embodiment, including a container and two bowl panels located inside the container.

In another aspect, the bowl panels 56 may be folded up and placed inside the container 50. FIG. 10 is an exploded view of a container assembly 70 comprising a container 50, a seal membrane 20, an overcap 14 and two bowl panels 56. The container 50 may comprise a sidewall 54 and an end cap 16. Instead of being packaged outside the containers 50 like in FIG. 6, the bowl panels 56 are rolled up and placed inside the container 50. The product 48 is contained in a flexible wrapper 11 and placed inside the container 50 within the space defined by the rolled up bowl panels 56.

The bowl panels 56 may be the same as or similar to those depicted in FIG. 8, and may be formed from a blank comprising locking tabs 62 and slots 64. The bowl panels 56 lock together to form a truncated cone shape having a circular bottom rim 60 configured to mate with the overcap 14 to form a bowl shaped serving container 57.

Second Embodiment—Separate can and Bowl; Tabs Form the Bowl Base

Alternatively, the container assembly 70 may comprise two flexible bowl panels 72 having bottom tabs 78 that form the bowl base.

Figure 11:
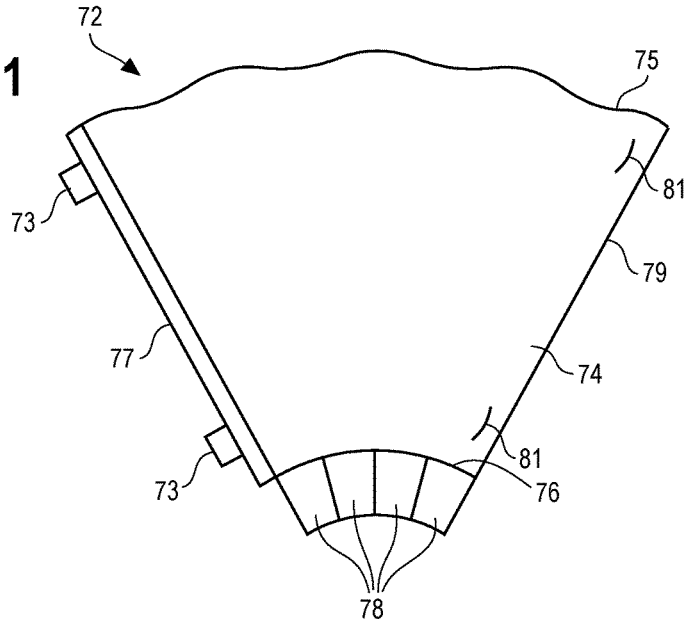
FIG. 11 is a front planar view of a bowl panel according to a third embodiment.

FIG. 11 is a front planar view of such a bowl panel 72. The bowl panel 72 is formed from a flat blank comprising a main panel 74 having a top edge 75, a bottom edge 76 and side edges 77, 79 extending from the top edge 75 and converging toward each other until they terminate at the bottom edge 76. A plurality of locking tabs 73 extend laterally outwardly from one side edge 77. Slots 81 located near the other side edge 79 are configured to receive the locking tabs 73 of a second bowl panel 72. Unlike the bowl panels 56 in FIGS. 8 and 9, the bowl panels 72 further comprise a plurality of bottom tabs 78 rotatably connected to the bottom edge 76. The tabs 78 are configured to interlock to form the bottom 82 of the bowl 80.

Figure 12:
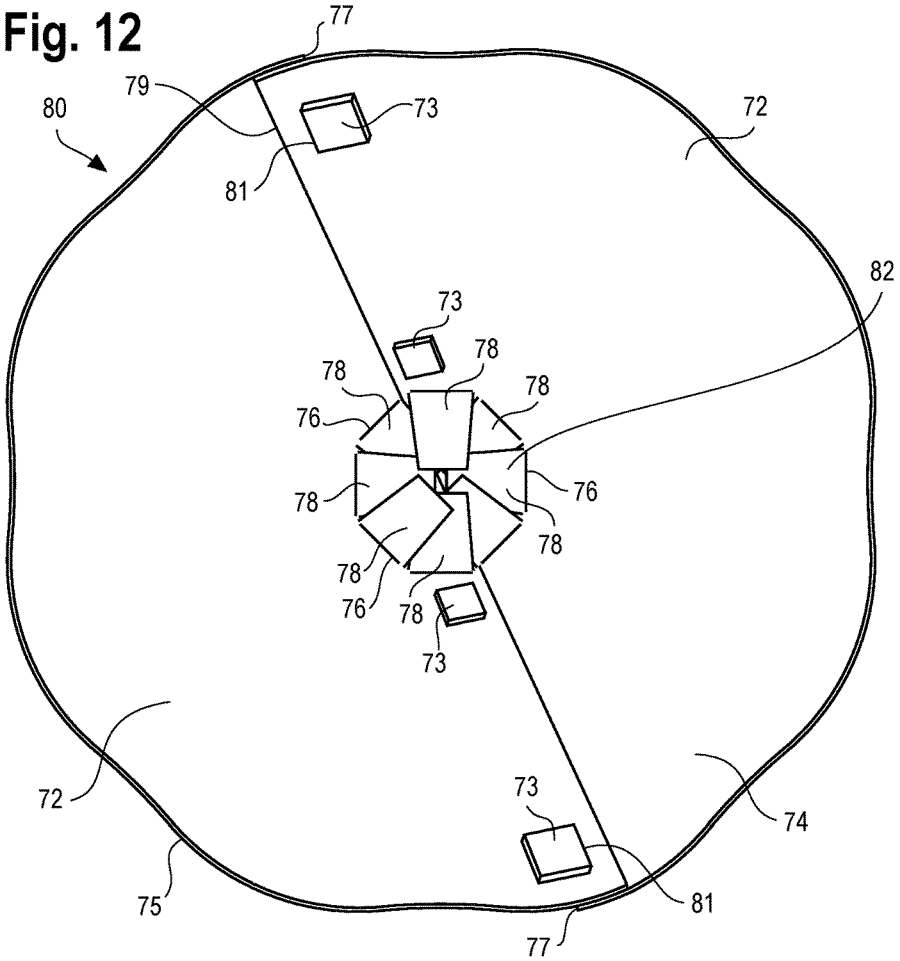
FIG. 12 is a top view an assembled bowl according to the third embodiment.
Figure 13:
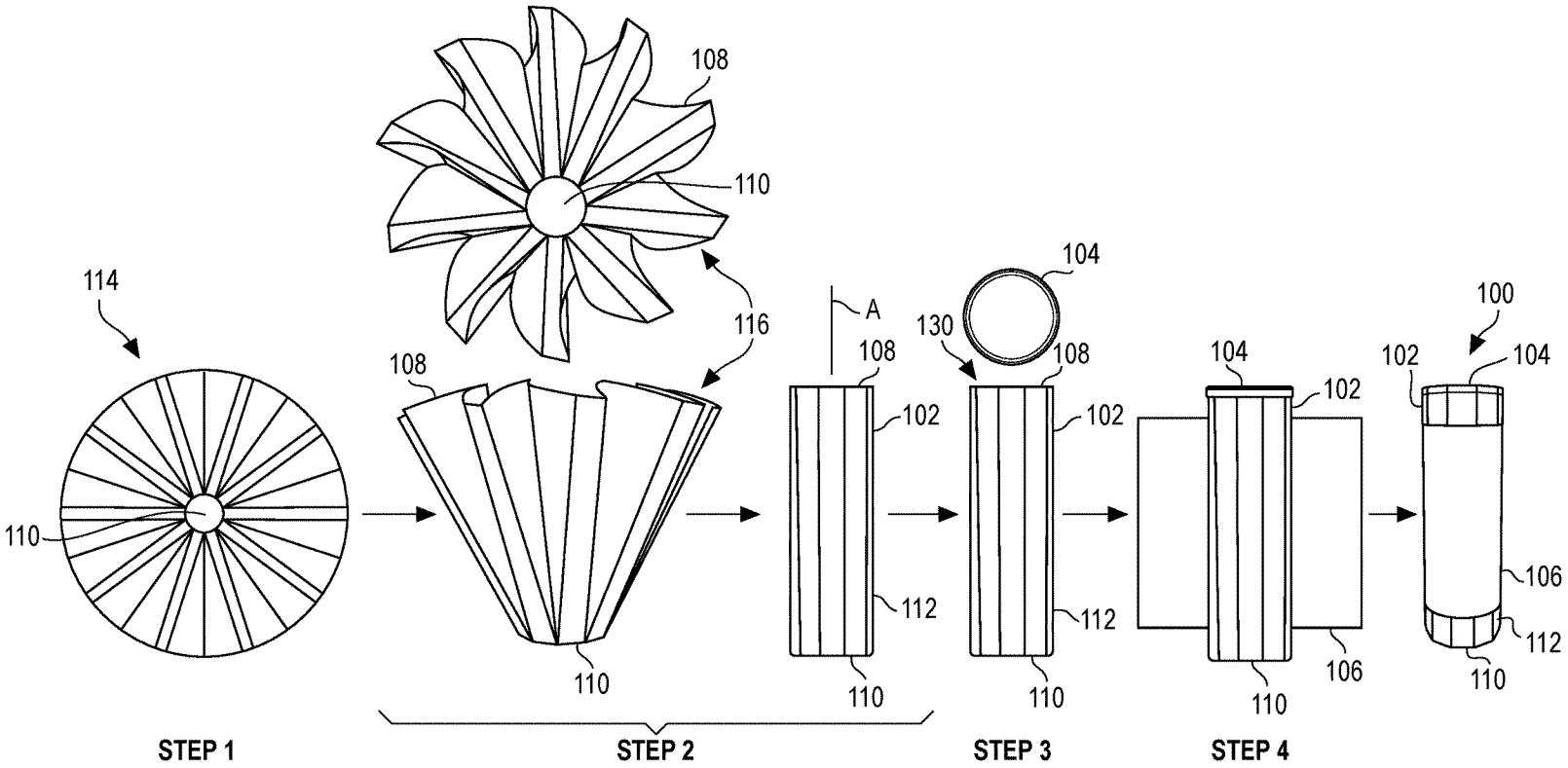
FIG. 13 is a schematic diagram showing steps in the manufacture of a container according to a fourth embodiment.

FIG. 12 is a top view an assembled serving bowl 80 made from two bowl panels 72 like the one shown in FIG. 11. The two bowl panels 72 lock together to form a truncated cone shaped serving bowl 80 large enough to hold the product 48 of one or more containers 50. For a two piece "bowl", each panel 72 may be bent as shown in FIG. 12 so that the top edges 75 and the bottom rims 76 both describe a 180 degree arc.

The bowl panels 72 may be packaged with one or more the containers 50 and may be folded, bent or otherwise configured to fit closely with the outside contours of one or more container 50. Alternatively, the bowl panels 72 may be rolled up and placed inside the container 50. The product may be contained in a flexible wrapper 11 and may be located inside the rolled up bowl panels 72.

Third Embodiment—Pleated Container

In a third embodiment shown in FIG. 12 a container 100 is provided comprising a pleated container body 102, an overcap 104 and a label 106.

The pleated container body 102 is substantially cylindrical and has a bottom wall 110 and a sidewall 112 that defines a longitudinal central axis (A). The sidewall 112 may have a beaded or unbeaded top rim 108.

The plastic overcap 104 may be removably secured to the top rim 108. The pleated container body 102 and overcap 104 define an interior 130 for holding the product (not shown).

The label 106 encircles the sidewall 112 and keeps the pleated container body 102 from opening up.

The pleated container body 102 is configured to splay outwardly after the label 106 has been removed, away from the central axis A, to form a frustoconical shaped structure—similar to the bowl-like structure 116 shown in FIG. 12, large enough to hold the product of one or more containers 100.

Method of Manufacture

The container 100 may be made as follows:

Step 1: Provide a round flat body blank 114. The body blank 114 may be pre-folded Step 2: Form the flat body blank 114 around a cylindrical mandrel to create a cylindrical or container shaped pleated container body 102 having a bottom wall 110 and a sidewall 112.

Optionally, form a bead on the top rim of the sidewall 112 using a forming machine. This step is not shown in FIG. 12.

Step 3. Apply the overcap 104 onto the top rim 108 of the pleated container body 102.

Step 4. Convey the pleated container body 102 to a labelling unit and apply a label 106 to the pleated container body 102 using a convolute winding machine to create the finished container 100.

It is understood that the embodiments of the invention described above are only particular examples which serve to illustrate the principles of the invention. Modifications and alternative embodiments of the invention are contemplated which do not depart from the scope of the invention as defined by the foregoing teachings and appended claims. It is intended that the claims cover all such modifications and alternative embodiments that fall within their scope.

The invention claimed is:

1. In combination, a container and flexible bowl panels for holding and serving a product, the container comprising:

a cylindrical sidewall having a top rim and a bottom rim;

a plastic overcap removably secured to the top rim;

an end cap secured to the bottom rim;

the cylindrical sidewall, overcap and end cap defining an interior for holding the product;

the bowl panels configured to lock together to form a bowl shaped serving container, wherein:

the bowl panels lock together to form a truncated cone shape having a circular bottom rim configured to mate with the overcap to form the bowl shaped serving container.

2. The combination container and flexible bowl panels of claim 1, wherein:

the bowl panels lock together in tab in slot fashion.

3. The combination container and flexible bowl panels of claim 1, wherein:

each bowl panel has an inner surface suitable for contacting food.

4. The combination container and flexible bowl panels of claim 1, wherein:

the bowl panels are configured to fit closely with outside contours of one or more containers.

5. The combination container and flexible bowl panels of claim 1, wherein:

the bowl panels are disposed inside the container.

6. In combination, a container and flexible bowl panels for holding and serving a product, the container comprising:

a cylindrical sidewall having a top rim and a bottom rim;

a plastic overcap removably secured to the top rim;

an end cap secured to the bottom rim;

the cylindrical sidewall, overcap and end cap defining an interior for holding the product;

the bowl panels configured to lock together to form a bowl shaped serving container, wherein:

each bowl panel is formed from a flat blank comprising a main panel having a top edge, a bottom edge and side edges extending from the top edge and converging toward each other until they terminate at the bottom edge, a plurality of locking tabs extending laterally outwardly from one side edge, slots located near the other side edge and configured to receive the locking tabs of a second bowl panel, and a plurality of bottom tabs rotatably connected to a bottom edge and configured to interlock to form a bottom of the bowl.

7. The combination container and flexible bowl panels of claim 6, wherein:

the bowl panels are configured to fit closely with outside contours of one or more containers.

8. The combination container and flexible bowl panels of claim 6, wherein:

the bowl panels are disposed inside the container.

* * * * *